US011446684B2

(12) United States Patent
Shah

(10) Patent No.: US 11,446,684 B2
(45) Date of Patent: Sep. 20, 2022

(54) AIR-WASH POWDER SIEVING APPARATUS FOR POWDER COATING SYSTEM

(71) Applicant: Amal Bhupendra Shah, Mumbai (IN)

(72) Inventor: Amal Bhupendra Shah, Mumbai (IN)

( * ) Notice: Subject to any disclaimer, the term of this patent is extended or adjusted under 35 U.S.C. 154(b) by 599 days.

(21) Appl. No.: 16/487,588

(22) PCT Filed: Sep. 7, 2018

(86) PCT No.: PCT/IN2018/050582
§ 371 (c)(1),
(2) Date: Aug. 21, 2019

(87) PCT Pub. No.: WO2019/069320
PCT Pub. Date: Apr. 11, 2019

(65) Prior Publication Data

US 2020/0055066 A1 Feb. 20, 2020

(30) Foreign Application Priority Data

Oct. 3, 2017 (IN) ..... 201721035041

(51) Int. Cl.
*B05B 7/14* (2006.01)
*B05B 15/40* (2018.01)
*B07B 1/55* (2006.01)

(52) U.S. Cl.
CPC ..... *B05B 7/1472* (2013.01); *B05B 7/1463* (2013.01); *B05B 7/1486* (2013.01); *B05B 15/40* (2018.02); *B07B 1/55* (2013.01)

(58) Field of Classification Search
CPC ... B05B 7/1445; B05B 7/1472; B05B 7/1463; B05B 7/1486; B05B 15/40; B07B 1/54; B07B 1/55
See application file for complete search history.

(56) References Cited

U.S. PATENT DOCUMENTS 4,770,344 A 9/1988 Kaiser
5,678,770 A * 10/1997 Shah ..... B05B 5/0531 361/228
10,322,426 B2 6/2019 Shah
2008/0017103 A1* 1/2008 Fulkerson ..... B05B 7/1454 118/308

(Continued)

FOREIGN PATENT DOCUMENTS

IN 2004MU2014 A 6/2015

OTHER PUBLICATIONS

International Search Report and the Written Opinion of the International Searching Authority, issued in corresponding International Application No. PCT/IN2018/050582, dated Nov. 2, 2018, 7 pages.

*Primary Examiner* — Vishal Pancholi
(74) *Attorney, Agent, or Firm* — Rothwell, Figg, Ernst & Manbeck, P.C.

(57) ABSTRACT

The present invention provides an air-wash powder sieving apparatus for a powder coating system having a powder spray gun, a powder suction pump assembly, and a powder container/hopper. The said sieving apparatus includes a housing, a sieving section and at least one air jet section adapted within the housing, for directing compressed air on the sieve. The compressed air impinged by the air jets onto the sieving mesh not only skims and washes the sieving mesh and keeps it de-clogged but also acts as a secondary air of the powder suction pump.

5 Claims, 6 Drawing Sheets

(56) References Cited

U.S. PATENT DOCUMENTS

| | | | | |
|---|---|---|---|---|
| 2012/0282398 | A1* | 11/2012 | Fulkerson | B05B 14/10 427/180 |
| 2013/0019970 | A1* | 1/2013 | Kleineidam | B05B 12/14 137/1 |
| 2016/0250653 | A1* | 9/2016 | Shah | B05B 7/1445 209/250 |

* cited by examiner

AIR-WASH POWDER SIEVING APPARATUS FOR POWDER COATING SYSTEM

CROSS REFERENCE TO RELATED APPLICATION(S)

This application is a 35 U.S.C. § 371 National Phase Entry Application from PCT/IN2018/050582, filed Sep. 7, 2018, designating the United States, which claims priority upon Indian Patent Application No. 201721035041, filed Oct. 3, 2017. The disclosures of each of the above-referenced applications are herein incorporated by reference in their entirety.

FIELD OF THE INVENTION

This invention relates to an air-wash powder sieving apparatus for a powder coating system.

BACKGROUND OF THE INVENTION

Generally, a powder paint coating system comprises a container/hopper for fluidizing powder, a powder suction pump for the suction of the powder and a powder spray gun for charging and spraying the powder for providing a protective coating over a work-piece to be coated. These components are mounted on a trolley and connected by hoses and cables with all the necessary regulators and fittings to complete the powder paint coating system. The conventional powder suction pump assembly (50) of the powder coating system is shown in FIG. 5B comparing with a powder pump assembly of the present invention. As shown in FIG. 5B, the conventional powder suction pump (10) comprises two air inlets namely primary/conveying/suction air inlet (12) (herein after referred as 'primary air inlet') and secondary/carrier/dosing air inlet (14) (herein after referred as 'secondary air inlet'). A primary air inlet (12) is an inlet for compressed air which is creates the suction and is responsible for the quantity of powder output from the pump (10). The suction of powder takes place when high pressure air is introduced into the powder suction venturi pump via the primary air inlet (12) through a nozzle having of small orifice (not shown). The volume of high pressure air being introduced is very low. This air volume is insufficient to carry the sucked powder smoothly through the hose and through the gun and hence the spray pattern with such a small volume of suction air is not uniform but lumpy and streaky. Therefore, an additional secondary/carrier air of adjustable volume is added in the pump (generally in the stream of flowing powder) from the secondary air inlet (14) to aid the smooth movement as well as the speed of powder through the hose and gun and thereby achieve the uniform spray output.

Generally, fresh powder is packed in boxes and transported over long distances by the powder manufacturer to the user. During transportation it is observed that the powder gets agglomerated in the box itself. Further it is also observed that recovered powder is collected in bins and later transported to the sieving machine and from sieve machine to the powder hopper for collection, storage and for feeding to the spray gun, using pumps or often by manual transfer. This transport action leads to agglomeration of powder. Moisture and contaminants also may creep into the powder after receipt and during usage. Thus, the powder needs to be sieved prior to use.

As per the standard conventional methods used in the powder coating industry, powder is passed through a sieving device operating on a vibratory or gyratory or rotary motion—using known means such as pneumatic, electric, mechanical or ultrasonic methods. These sieve machines may be placed under the recovery system or may be separately placed outside of the powder recovery system. The sieved powder is then transported to the hopper or container of the powder spray gun.

The powder suction pump sucks and transports the powder from the hopper/container to the gun tip and out of the spray gun. Powder is sprayed from the tip of the gun of the powder spray equipment. The Powder spray gun sprays and electrostatically charges the powder which adheres onto the work-piece which needs to be powder coated. This charged powder adheres to the work-piece due to the electrostatic charging. The over sprayed powder is then collected in a chamber and recovery system such as powder spray cum recovery booth. The ratio of the amount of powder adhering to the work-piece to the amount of powder sprayed out of the powder spray equipment is called transfer efficiency.

Sieving with standard conventional methods, is quite expensive, bulky, time consuming and complex in operation. Additionally, powder sieving needs a separate area for placement which must be accommodated in the plant design. The agglomerated powder along with moist air and contaminants can choke the sieve mesh. This hampers further sieving operation. The sieve machines, after a while, have to be cleaned periodically either manually or by designing some automated method and this is an expensive and cumbersome process.

Moisture and other factors make the powder agglomerated and lumpy despite prior sieving as the powder is hygroscopic in nature and moisture can be picked up by the powder while lying in the powder container or while it is being transported from the recovery and sieving units back to the powder container for re-use. This agglomeration of the moist powder is a big source of an un-even powder coat, poor transfer efficiency, poor flow and poor finish.

Generally, sieve machines are integrated with the recovery units or placed under the recovery zone or placed separately outside the recovery unit. Further, powder collected in the recovery zones tends to get contaminated with impurities and other particles. Many a time it is this contaminated powder which is transported back to the master powder container with or without sieving either by pneumatic or mechanical means.

Further, in spite of the best sieving of the powder prior to transportation to the master spray container for further spraying, impurities can creep in during this process. Powder in the master spray container often still gets contaminated or even agglomerated due to various reasons such as absorption of moisture as it is continuously fluidized for long periods without being consumed especially since the powder is hygroscopic in nature. Another point of agglomeration is that the powder remaining stagnant within the powder container overnight for long periods of time. In such cases, even the prior sieved powder is subsequently coagulated and gets sprayed in the coagulated form.

Considering the above said problems, inventor of the present invention has filed a patent application published as WO2015/193919 to sieve the powder in real time. That is just at time of coating operation. The apparatus disclosed in the said application is a vibrating apparatus comprising powder pump assembly connected to a vibrating device through a powder suction tube wherein the vibrating device is configured for real time sieving of powder just before spraying. Pneumatic means are used as the vibrating device for the purpose of anti-blinding and keeping the sieve free of clogging. However, the system as disclosed is prone to periodic maintenance due to the presence of moving parts. The pneumatic vibrator causes mechanical stress on the apparatus and requires periodic maintenance. More over the movement of anti-blinding pellets on the sieve causes wear and tear of the sieve mesh which required periodic replacement.

Therefore, there is still a need of a means for sieving the powder in real time before spraying the power, that will solve one or more of problems as discussed above.

SUMMARY OF THE INVENTION

Accordingly, the present invention provides a powder sieving apparatus for a powder coating system having a powder spray gun, a powder suction pump, and a powder container/hopper. The said sieving apparatus comprises a housing for connecting to a suction side of the powder suction pump assembly, a sieving section within the housing, said sieving section having at least one sieve mesh, and an air-jet section having one or more orifices and an inlet adapted within the housing for providing compressed air to the orifice(s). The said air-jet section is configured such that the jets of air from the orifice(s) skims and washes the sieve to prevent clogging and ensure continuous flow of freshly sieved smooth flowing powder through the powder coating system.

According to the present invention, the sieving apparatus envisages to ensure smooth and even flow of powder from even coagulated and impurity laden powder from the container containing non-sieved powder. The suction action of the powder suction pump forces the powder through the sieve(s) during suction for output. The air injected by the air-jet orifice(s) constantly washes and cleans the sieve(s) and keep the sieve(s) free from blockages and clogging by a high-pressure low volume air wash.

According to an embodiment of the present invention, the sieving apparatus comprises the housing integrated with the suction side of the powder suction pump assembly. According to the present invention integration of the apparatus includes removable, fixed or inbuilt integration of the apparatus with the powder suction pump assembly.

According to an embodiment of the invention, the inlet of compressed air of the air-jet section acts as the secondary air inlet for the powder suction pump.

According to an embodiment, the air-jet orifice(s) are adapted either above or below or above and below the sieve section directing the jets of compressed air towards the sieve mesh for the purpose of washing the sieve mesh and keeping it free of clogging.

According to an embodiment of the invention, a powder suction pump can be manufactured with inbuilt air-wash powder sieving apparatus of the present invention by combining housing of the air-wash powder sieving apparatus with the body of the powder suction pump to form a single integrated unit.

According to the present invention, the compressed air impinged by the air-jet orifice(s) onto the sieve mesh, after cleaning and washing the sieve mesh to keep it de-clogged, itself gets sucked along with the powder and this air aids the smooth movement of the powder through the de-clogged sieve mesh, powder suction pump and hose and thus ensures that the powder is uniformly emitted out of the spray gun. Thus, this compressed air itself acts as the secondary air thereby eliminates the need for a separate compressed air inlet for the secondary air of the powder suction pump assembly, whilst keeping the sieve de-choked for smooth flow of powder. The air-jet section air inlet performs the dual function of air impingement for cleaning as well as the secondary air function of the powder suction pump assembly.

Further, the air-wash powder sieving apparatus ensures smooth and even flow of powder from even coagulated and impurity laden powder also. The suction action of the powder suction pump forces the powder through the sieve(s) during suction for output. The air injected by the air-jet orifice(s) constantly washes and cleans the sieve(s) and keep the sieve(s) free from blockages and clogging by a high-pressure low volume air wash.

BRIEF DESCRIPTION OF DRAWINGS

The above and other aspects, features, and advantages of certain exemplary embodiments of the present invention will be more apparent from the following description taken in conjunction with the accompanying drawings in which.

DETAILED DESCRIPTION OF THE INVENTION

In general, the present invention provides an air-wash powder sieving apparatus for a powder coating system having a powder spray gun, a powder suction pump assembly, and a powder container/hopper. The said sieving apparatus includes a housing, a sieving section and at least one air-jet section adapted within the housing, for directing compressed air on the sieve. The compressed air impinged by the air-jets onto the sieving mesh not only skims and washes the sieving mesh and keeps it de-clogged but also acts as a secondary air of the powder suction pump. The suction action of the powder suction pump sucks the powder through the sieve(s) during suction for output.

Figure 1:
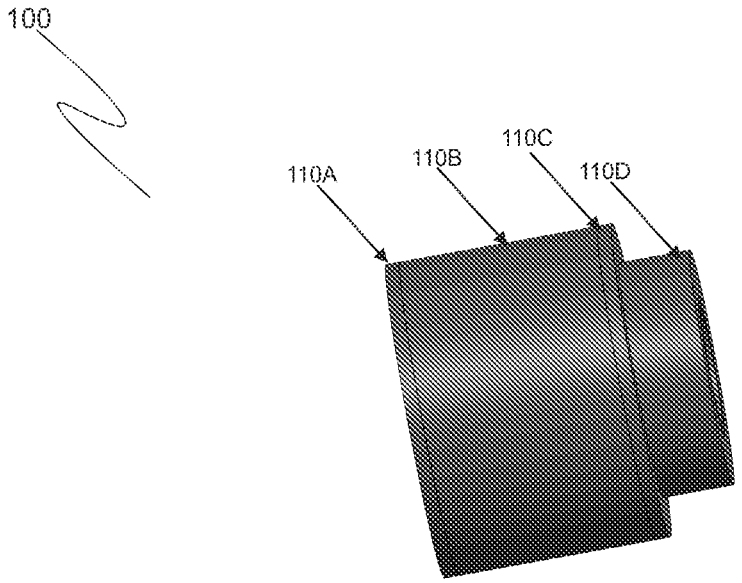
FIG. 1 shows an assembled view of an air-wash powder sieving apparatus in accordance with an embodiment of the invention.
Figure 2:
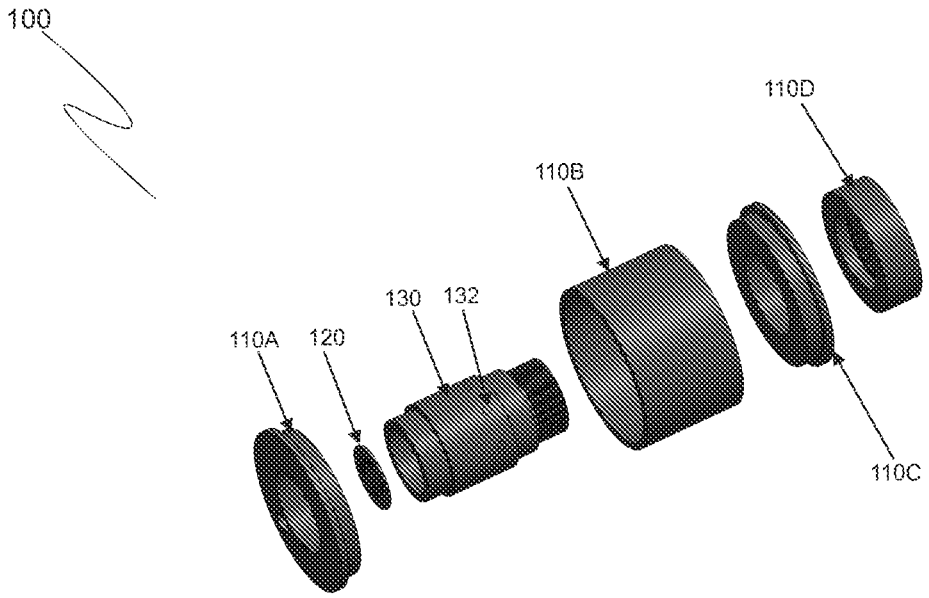
FIG. 2. shows an exploded view of components of the air-wash powder sieving apparatus as shown in FIG. 1.

Referring FIG. 1 shows an air-wash powder sieving apparatus (100) for a powder coating system according to the preferred embodiment of the present invention and FIG. 2 shows an exploded view of the air-wash powder sieving apparatus (100) shown in FIG. 1.

As shown in FIG. 2, the powder sieving apparatus (100) comprises a housing in four parts (110A, 110B, 110C and 110D), a sieving section (120) and an air-jet section (130). The four parts of the housing, the sieve section and air-jet section are fixed together by known means including but not limited to screws, nuts, nut-bolts, snap-fitting, push fitting arrangements and the like. Alternatively, the four parts of the housing (110A, 110B, 110C and 110D), the sieve section (120) and the air-jet section (130) can be fixed together permanently to form a use-and-throw assembly of the air-wash powder sieving apparatus.

The sieve section (120) is inserted and fits into the air-jet section (130) by slide-fit means (not shown). This assembled sieve section (120) and air-jet section (130) is now inserted into the mating grooves (not shown) of the upper housing lid (110A). This assembly of the upper housing lid (110A) and the assembled sieve section (120) and air-jet section (130) is now inserted into the housing middle body (110B) and fit together by snap fit means. This entire assembly is held in place by threads (not shown) provided on the air-jet section (130) and the nut (not shown) provided in the lower housing body (110D) with the lower housing lid (110C) acting as the closure plate. This forms a gap ('G'—Refer FIG. 5A) between the housing middle body (110B) and the air-jet section (130). Though, in the FIG. 2, the sieving section (120) comprising a single sieving mesh is shown, the apparatus may comprise a plurality of sieves adapted in the sieving section and a plurality of air jet orifice(s) for the first/last sieve or each sieve having separate air jet orifice(s) for cleaning, washing and de-clogging.

Figure 5A:
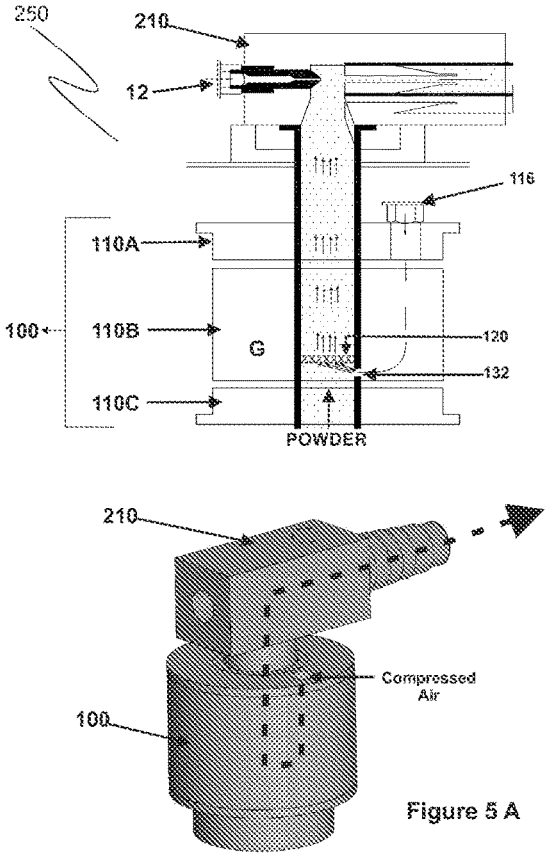
FIG. 5 shows a comparison between a conventional powder suction pump assembly in FIG. 5B and air-jet powder suction pump assembly in accordance with an embodiment of the invention in FIG. 5A including cross sectional views.

As shown in FIGS. 2 and 5A, the air-jet section (130) comprises one or more air jet orifices (132). The air jet orifices (132) are the small openings or holes that direct compressed air on the sieve mesh(s) (120). The inlet for compressed air (116) is preferably provided on the upper housing lid (110A) in the gap (G) formed between the housing middle body (110B) and the air-jet section (130). As shown in the FIGS. 2 and 5A, the air jet orifice(s) (132) are preferably provided below the sieve section (120). The compressed air supplied to the air jet orifice(s) perform the dual function such as cleaning and washing the sieve and also acts as secondary air of the powder suction pump. Alternatively, the air jet orifice(s) may be provided above the sieve directing compressed air on the sieve or below and above the sieve section for skimming on the sieve mesh and cleaning, washing and de-clogging it.

Figure 3:
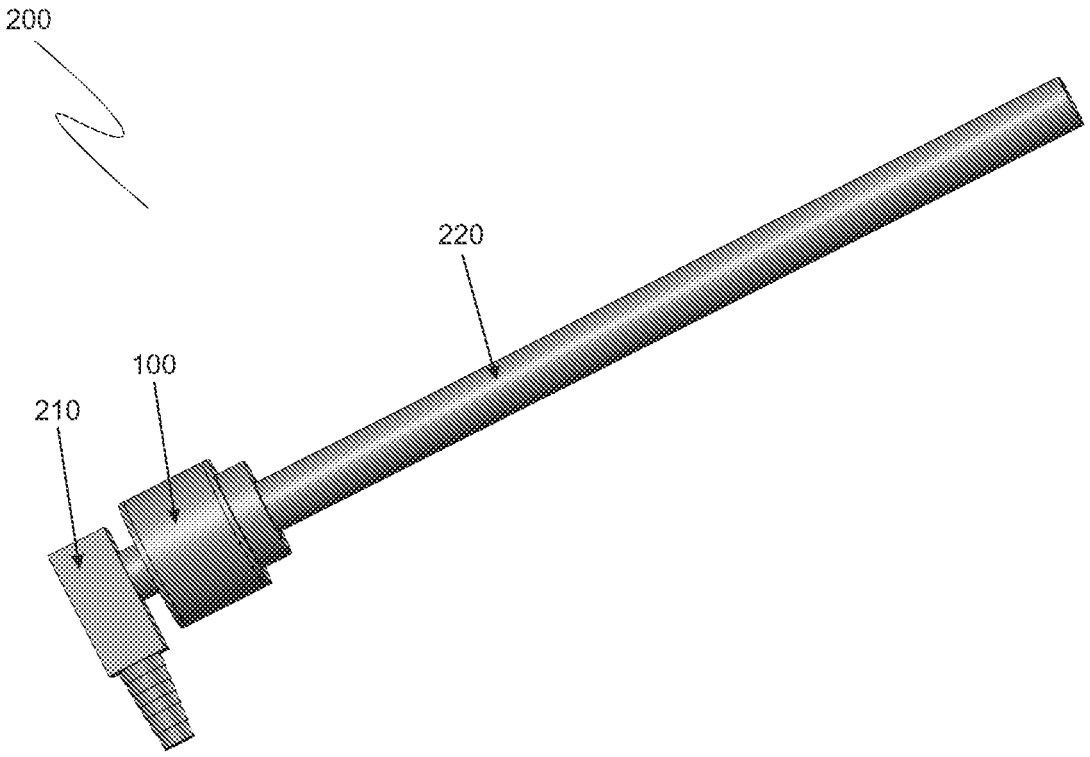
FIG. 3 shows a powder pump assembly comprising an air-wash powder sieving apparatus integrated with a powder suction pump and a powder pick up tube in accordance with an embodiment of the invention.
Figure 4:
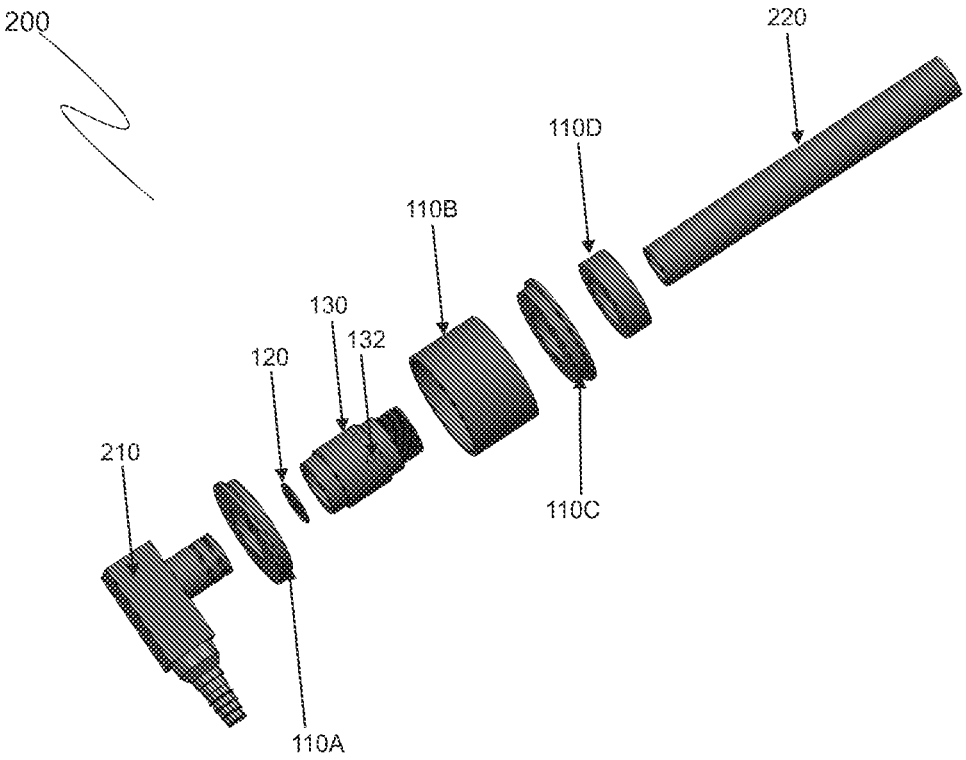
FIG. 4 shows an exploded view of the powder pump assembly as shown in FIG. 3.

Referring FIGS. 3 & 4 shows an air-wash powder sieving apparatus integrated with a powder suction pump and a powder pick up tube of a powder suction pump assembly (200) according to an embodiment of the present invention wherein the air-wash powder sieving apparatus (100) is fitted between the suction end of a powder pump (210) and a powder pick up tube (220) for a powder coating system. FIG. 4 shows an exploded view of the assembly shown in FIG. 3.

Referring FIGS. 3 & 4, the powder sieving apparatus (100) is assembled as shown and discussed above for FIG. 2. Then, the powder suction pump (210) is pushed to fit into the upper end of the air-jet section (130) of the powder sieving apparatus (100) and the powder suction pipe (220) is snap fitted at the lower end of the air-jet section (130) of the powder sieving apparatus (100) forming the powder suction pump assembly (200). The air-wash powder sieving apparatus (100) may be adapted below the powder suction tube (220), wherein the powder suction pump is integrated with the suction tube and the air-wash powder sieving apparatus can be submerged partially or wholly into the powder.

Figure 5B:
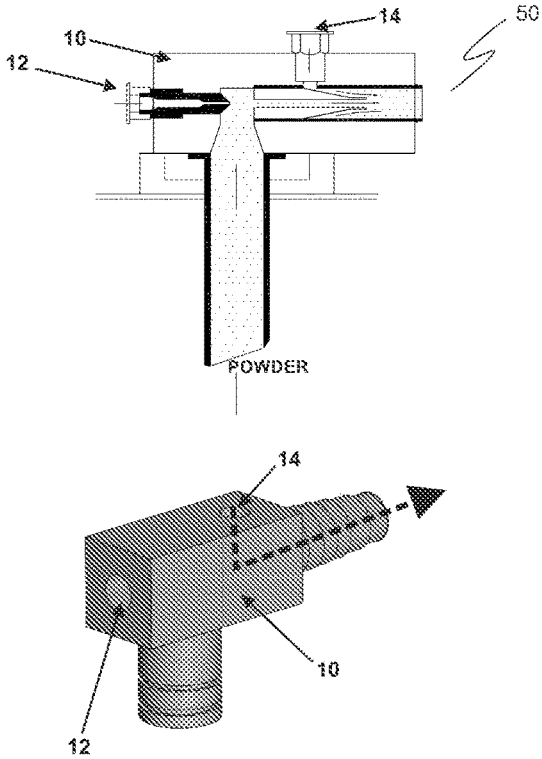

FIG. 5 shows the powder suction pump assembly (250) according to an embodiment of the present invention in FIG. 5A and a conventional powder suction pump assembly (50) in FIG. 5B. FIGS. 5A and 5B show a path of movement of the primary/suction air and the secondary/carrier air within the both assemblies. As shown in FIG. 5A, the powder gets continuously screened through the sieve mesh (120) thereby not allowing lumps to pass through the sieve mesh and this sieving also causes a uniform distribution of the powder, whereas in the conventional suction powder pump assembly as shown in FIG. 5B, powder lumps may pass through the pump thereby may cause un-even powder coat, poor transfer efficiency, poor flow and poor finish. Moreover, the air-jet powder suction pump assembly (250) of the present invention as shown in FIG. 5A does not require secondary/carrier air inlet on the powder suction pump (210).

Essentially the powder suction pump shown in FIG. 5A is the same as the powder suction pump shown in FIG. 5B but without a secondary/carrier air inlet. Thus, one can use the conventional pump as shown in FIG. 5B by closing the secondary/carrier air inlet (14). The conventional pump can also be used with the air-wash powder sieving apparatus with air-jet inlet (116) being a separate air inlet and the conventional pump having separate both primary air inlets (12) and secondary air inlets (14).

Figure 6:
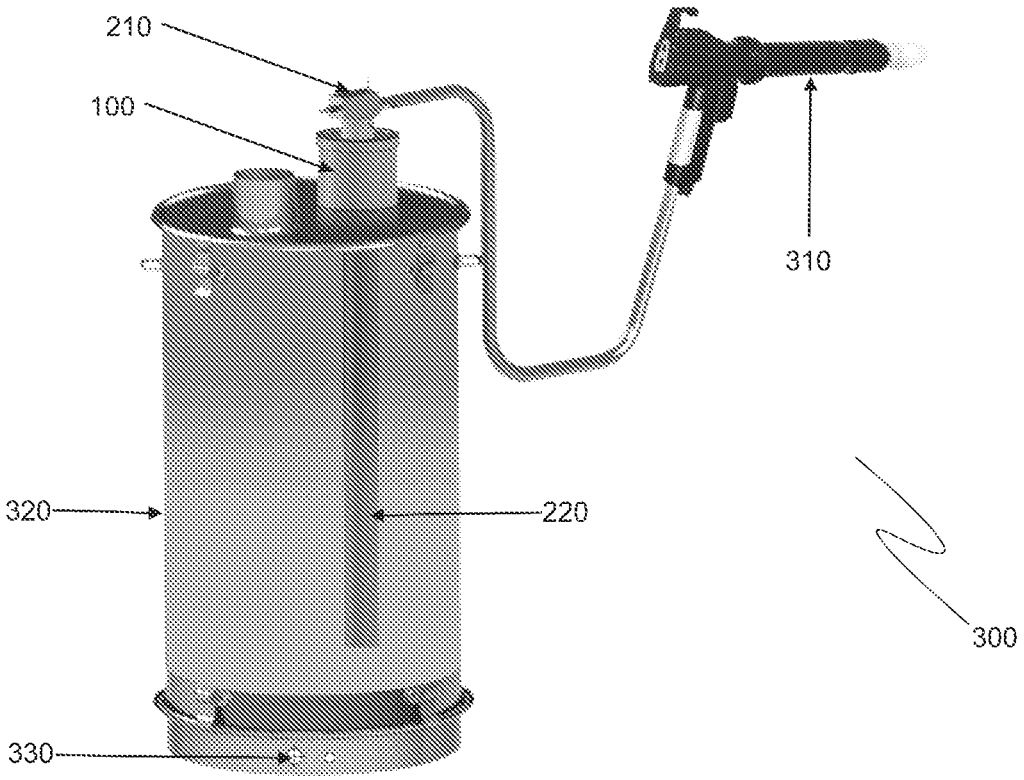
FIG. 6 shows a powder coating system incorporating the air-wash powder sieving apparatus in accordance with an embodiment of the invention.

FIG. 6 shows that a powder coating system (300) comprising air-jet powder suction pump (210) integrated with an air-wash powder sieving apparatus (100) and the powder pick up tube (220) according to the present invention connected between a powder spray gun (310) and a powder container (320).

In a method of operation, the powder to be coated is kept in fluidized state in the container by a compressed air through an air inlet (330). The powder is sucked through the powder pick up tube (220) with the help of the powder suction pump (210) and passes though the sieving apparatus (100) of the present invention. The powder sucked by a suction force created by the primary air of the powder suction pump, is forced through the sieve mesh. The compressed air injected through the air-jet orifice(s) onto the sieve mesh, skims, washes, cleans and de-clogs the sieving mesh. Further, this compressed air injected through the air jet orifice(s) also after cleaning the sieving mesh, is sucked along with the powder and aids the powder movement through powder hose and powder spray gun in a way that uniform flow is created. The powder forced through the sieving mesh has its lumps broken and the powder particles sieved just prior to spraying. The powder filtered through the sieving apparatus is free flowing powder which will be charged at the tip of the powder spray gun for coating onto a workpiece.

The compressed air injected by air-jet orifice(s) that washes the sieve mesh and keeps the sieve mesh constantly cleaned and free from blockages, is a high-pressure low volume impingement of air. This compressed air also performs the secondary/carrier air/dosing function of the powder suction pump and thereby eliminates the need for a separate dosing/secondary air inlet connection to the powder suction pump.

The present apparatus ensures that the freshly sieved powder is free of large impurities and the powder particles are distinctly separated and presented to the charging device such as a powder spray gun and the particles are thus charged better resulting in better transfer efficiency. The smaller mass of the individual powder particles versus the lumped powder particles make them more tenable to easily accepting an electrostatic charge. The distinctly separated powder particles of the sieved powder ensure a superior powder cloud emitted out of a spray gun and a more even and smooth powder flow with better uniformity and improved deposition efficiency. The present air-wash powder sieving apparatus is a non-vibrating static sieving apparatus which eliminates wear and tear of the apparatus as there are no moving parts and ensures minimal maintenance with continuous flow in real time.

The sieving apparatus including parts such housing, air jet section, and the like can be preferably made of plastic or metal to ensconce the sieve mesh. The impinged air can be a of a different pressure or different air volume and that numerous modifications and adaptations may be made thereto without departing from the spirit and scope of invention. The sieving apparatus of the present invention can be easily adapted to the presently available powder coating systems. Further, a powder suction pump or pick-up tube can be manufactured with inbuilt air-wash powder sieving apparatus of the present invention by combining housing of the air-wash powder sieving apparatus with the body of the powder suction pump or body of pick-up tube without departing from the spirit and scope of invention.

Figures are merely representational and are not drawn to scale. Certain portions thereof may be exaggerated, while others may be minimized. Figures illustrate various embodiments of the invention that can be understood and appropriately carried out by those of ordinary skill in the art.

In the foregoing detailed description of embodiments of the invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the detailed description of embodiments of the invention, with each claim standing on its own as a separate embodiment.

It is understood that the above description is intended to be illustrative, and not restrictive. It is intended to cover all alternatives, modifications and equivalents as may be included within the spirit and scope of the invention as defined in the appended claims. For example, though the inlet for compressed air is shown at the top of the housing, it can be designed anywhere in and around the hosing and not limited to the top of the housing as it is shown for reference purpose. Moreover, the term "air" refer herein above includes "gas" also. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively.

The invention claimed is:

1. An air-wash powder sieving apparatus for a powder coating system having a powder spray gun, a powder suction pump assembly, and a powder container/hopper, said sieving apparatus comprising:

a housing for connecting to a suction side of the powder suction pump assembly;

a sieving section within the housing, said sieving section having at least one sieve mesh through which powder is forced by a suction action generated by a powder suction pump of the suction pump assembly; and an air-jet section having one or more air-jet orifices and an inlet for providing compressed air to the air-jet orifice (s) of the air-jet section wherein the air-jet section is configured in such a way that the compressed air from the air-jet orifice(s) skim and wash the sieve to prevent clogging and ensure continuous flow of freshly sieved smooth flowing powder through the powder coating system.

2. The air-wash powder sieving apparatus as claimed in claim 1, wherein the said apparatus is connected removably to the suction side of the powder suction pump.

3. The air-wash powder sieving apparatus as claimed in claim 1, wherein the said apparatus is integrated with the powder suction pump.

4. The air-wash powder sieving apparatus as claimed in claim 1, wherein the inlet of compressed air of the air-jet section acts as the secondary air inlet for the powder suction pump.

5. The air-wash powder sieving apparatus as claimed in claim 1, wherein the air-jet section orifice(s) are adapted either above, below or above and below the sieve section directing the compressed air towards the sieve mesh.

* * * * *